US005385027A

United States Patent [19]

Longsworth et al.

[11] Patent Number: 5,385,027

[45] Date of Patent: Jan. 31, 1995

[54] CONTINUOUS FLOW CRYOGEN SUBLIMATION COOLER

[75] Inventors: Ralph C. Longsworth; Ajay N. Khatri, both of Allentown, Pa.

[73] Assignee: APD Cryogenics, Inc., Allentown, Pa.

[21] Appl. No.: 109,390

[22] Filed: Aug. 19, 1993

[51] Int. Cl.[6] ..... F25B 19/00

[52] U.S. Cl. ..... 62/51.1

[58] Field of Search ..... 62/51.1, 51.3

[56] References Cited

U.S. PATENT DOCUMENTS

| | | | |
|---|---|---|---|
| 3,447,333 | 6/1969 | Goodstein | 62/51.3 |
| 4,228,662 | 10/1980 | Klipping | 62/51.1 |
| 4,474,036 | 10/1984 | Ball et al. | 62/51.1 |
| 4,480,682 | 11/1984 | Kaneta et al. | 62/51.1 |
| 4,538,423 | 9/1985 | Le Diouron | 62/51.1 |

FOREIGN PATENT DOCUMENTS 0932004 5/1982 U.S.S.R. .

OTHER PUBLICATIONS

Nast, T. C. "Status of Solid Cyrogen Coolers" *Advances in Cryogenic Engineering* vol. 31, 1985, pp. 835–849.

Caren, R. P. et al. "A Solid Cryogen Refrigerator for 50° K Infrared Detector Cooling" *Advances in Cryogenic Engineering,* vol. 13, pp. 451–461.

*Primary Examiner*—Ronald C. Capossela

*Attorney, Agent, or Firm*—Helfgott & Karas

[57] ABSTRACT

A device for cryogenic refrigerating of an object below the triple point temperature of the cryogen. The device includes a housing in which is placed a porous plug. A liquid cryogen is supplied to one side of the plug at a pressure greater than the triple point of the cryogen. A pressure below the triple point is maintained on the other side of the porous plug. The cryogen flows through the plug and forms a solid on the supply side of the plug. The solid cryogen provides cooling by sublimation on a continuous basis to a cold station thermally coupled to the plug.

21 Claims, 6 Drawing Sheets

CONTINUOUS FLOW CRYOGEN SUBLIMATION COOLER

BACKGROUND OF THE INVENTION

1. Field of the Invention

The present invention deals with the field of refrigeration and, more particularly to cooling cryogens to a temperature below their triple point for an extended period.

2. Description of Prior Art

Prior solid cryogen coolers which have been used to cool sensors in space have operated by filling a thermally conducting matrix with liquid then freezing it either by means of external refrigeration or exposing it to a vacuum and which produces cooling, first by evaporation of some of the liquid and then by sublimation of the solid. The two techniques in which the forming of solid cryogens has been achieved circulate a coolant through a specially provided loop attached to a tank. In the first approach, room-temperature gas is introduced into the tank and subsequently liquified and frozen in a continuous manner, while in the second, the tank is filled with liquid which is subsequently frozen by the circulated coolant. The coolant loop is also used for periodic cooling of the solid during vehicle integration and checkout in order to maintain the cryogens in a no-loss (nonvented) condition. Liquid nitrogen can be used as the coolant for many of the cryogens, while liquid helium is required for the lower temperature cryogens such as neon and hydrogen. As the solid cryogen sublimes, it will recede from areas of maximum heat flux such as the tank walls, the support attachment points, and the thermal connection to the sensor. In order to achieve near isothermal conditions for the instruments, a heat exchanger is utilized inside the tank. Depending upon the requirements, extended fins of foam metal may be used in effectively creating an isothermal heat sink of the combined tank/cryogen/heat-exchanger system.

These solid cryogen coolers only provide cooling as long as there is solid cryogen in the matrix and thus have to be warmed up to be refilled.

The present invention eliminates the problems mentioned above by providing a cooler which cools by sublimation of a cryogen for an extended period of time. Other advantages of the present invention over the prior art will also be rendered evident.

SUMMARY OF THE INVENTION

It is accordingly an object of the present invention to provide a continuous flow cryogen cooler.

Still another object of the present invention is to provide a cryogen cooler able to provide cooling without a solid cryogen in the matrix.

Yet a further object of the present invention is to provide a cryogen cooler having a porous plug able to accommodate changes in the thickness of solid cryogen.

A further object of the present invention is to provide a cryogen cooler which reduces the possibility of solid cryogen sticking to the walls of the housing.

Briefly, in accordance with the present invention there is provided a device for providing cryogenic refrigeration of an object below the triple point temperature of the cryogen utilized. The temperature is held at a stable value by sublimation of the solid cryogen in contact with a thermally conducting heat station. The device includes a housing in which is placed a porous plug and an outlet tube which extends outside the housing. A vacuum pump is attached to the end of the outlet tube extending outside the housing and a cold station is thermally coupled to the porous plug. Also included is a supply of liquid cryogen. When this device is run in a cold side down mode the top of the housing is tapered to reduce the possibility of solid cryogen sticking to the walls.

In operation a pressure less than the triple point pressure of the cryogen used is provided on one side of a porous plug through an inlet tube. The liquid cryogen is thus caused to flow to the other side through the porous plug at a pressure greater than the triple point pressure. When the liquid cryogen reaches the porous plug it solidifies and the flow through the porous plug is limited to the rate of sublimation of the solid cryogen. The porous plug is thus kept at a constant temperature, cooling the cold station to which it is thermally coupled and thus cooling the object in contact with the cold station. The temperature of sublimation remains substantially constant even when the pressure changes. However, the solid layer adjacent the porous plug changes dependent upon the heat load. Thus the object to be cooled can be maintained at a constant regulated temperature for a continuous period of time.

These and other objects, features, and advantages of the invention will, in part, be pointed out with particularity, and will, in part, become obvious from the following more detailed description of the invention, taken in conjunction with the accompanying drawings, which form an integral part thereof.

DETAILED DESCRIPTION OF THE PREFERRED EMBODIMENT

Figure 1:
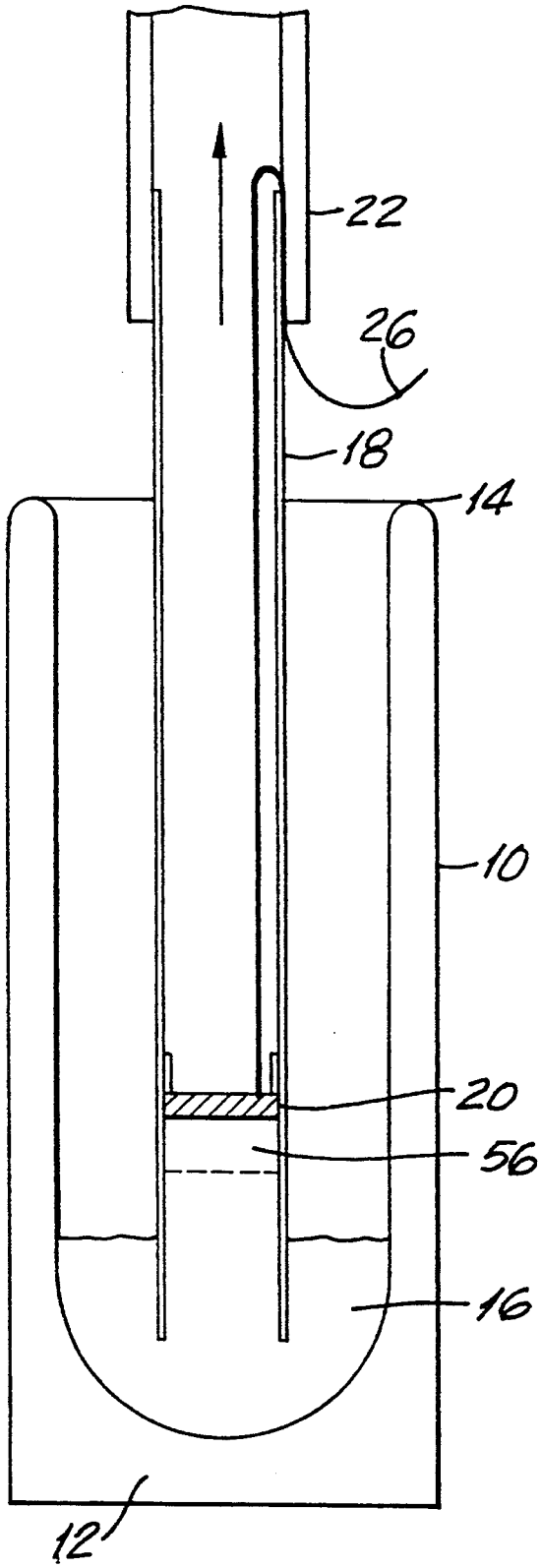
FIG. 1 illustrates a sublimation cooler.
Figure 2:
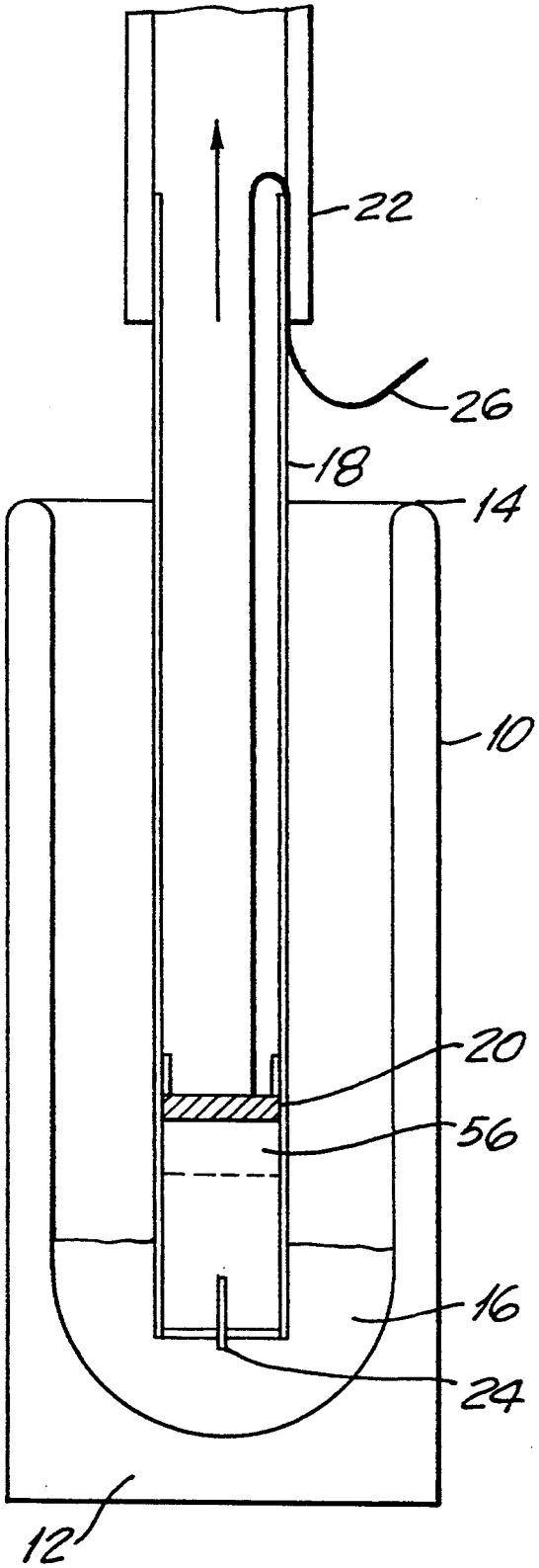
FIG. 2 illustrates the sublimation cooler of FIG. 1 including a flow restrictor.

The present invention will now be disclosed in detail using FIGS. 1–4. Components which perform identical functions are identified by the same reference numbers. FIGS. 1 and 2 illustrate the principles involved in the functioning of the present invention. Shown is a clear dewar 10. The dewar 10 serves as a housing having a closed base side 12 and an open top side 14. Inside the dewar 10 is placed a cryogen 16, in this example liquid nitrogen ($N_2$) is used as the cryogen although other cryogens can be used. Also within the dewar 10 and extending out above the top of the dewar 10 is a plastic tube 18. The plastic tube 18 is open at both ends and sits within the dewar 10 in the liquid $N_2$. The plastic tube 18 is positioned having its lower end a distance above base side 12 of the dewar 10. Within the plastic tube 18, above the level of liquid $N_2$ but far enough below the top of the dewar 10 to be insulated from excessive heat leakage, is a porous plug 20. The porous plug 20 may be made of any material which provides good heat transfer, copper is used in this instance for purposes of example only. Attached to the upper end of the plastic tube 18 is a tube 22 which is coupled to a vacuum pump. FIG. 2 further includes a flow restrictor 24 placed at the bottom end of the plastic tube 18 and below the porous copper plug 20. The flow restrictor 24 is placed far enough below the copper plug 20 so as to be immersed in the liquid $N_2$ and not to restrict operation of the cooler. Attached to the porous plug 20, to measure its temperature, is a thermocouple 26.

Figure 3:
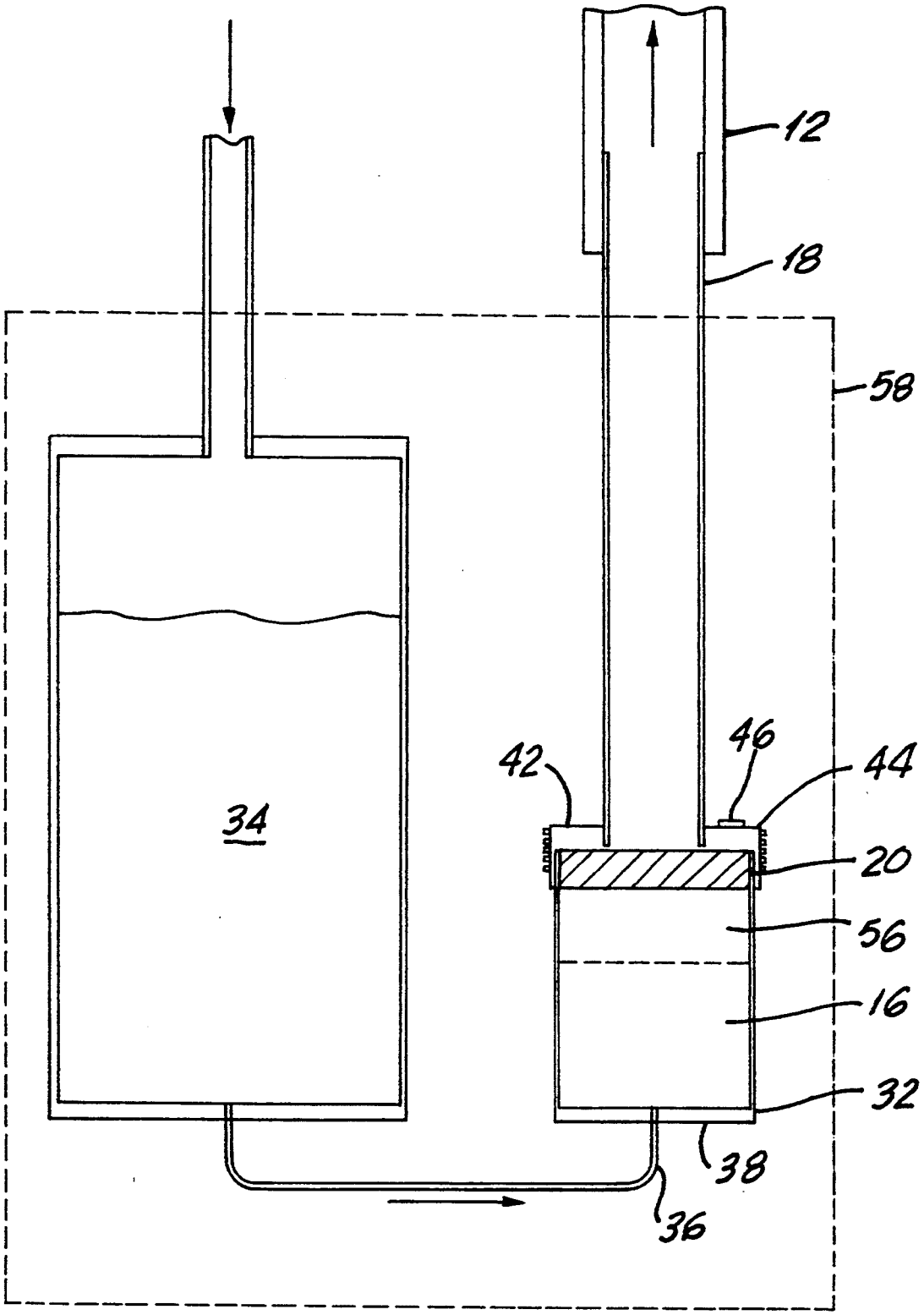
FIG. 3 illustrates a continuous through flow sublimation cooler with the cold side up.

FIG. 3 shows an entire cooler apparatus which operates according to the basic configuration shown in FIGS. 1 and 2. Illustrated by FIG. 3 is a continuous through-flow sublimation cooler oriented cold end up. Here a liquid cryogen 16 is contained in a housing 32. The cryogen 16 is supplied to the housing 32 from a cryogen reservoir 34 through an inlet tube 36, entering the housing through its base wall 38. At the top end of the housing 32 is a porous plug 20. Below the porous plug is where a solid layer of cryogen 56 forms during operation. The housing 32 is covered by a cap 42. Wrapped around the cap 42 and thermally coupled to the porous plug 20 is a cold station temperature sensor 46 and heater 44. The object to be cooled, not shown, is placed in contact with the cold station 42 temperature and is therefore thermally coupled to the cold station sensor 46 and heater 44 and thus also to the porous plug 20. Placed through a hole in the cap 42 ideally resting in a position above and not in contact with the porous plug 20 is an outlet tube 18. Attached to the other end of the outlet tube 18 is a tube 22 which couples to a vacuum pump. The assembly is typically mounted in a vacuum insulated cryostat 58.

Figure 4:
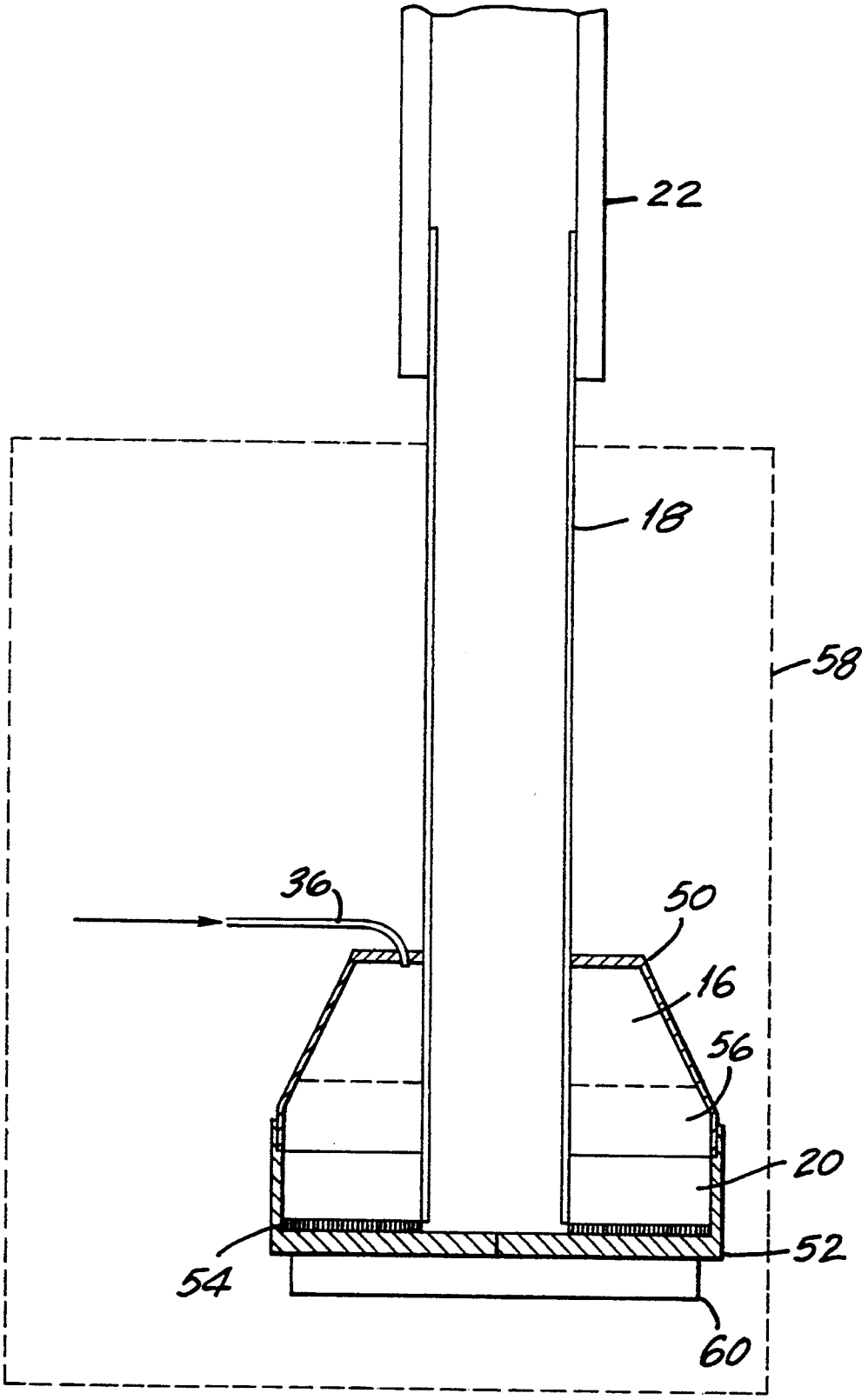
FIG. 4 illustrates a continuous flow sublimation cooler with the cold side down.

FIG. 4 illustrates a continuous flow sublimation cooler oriented cold end down but may be operated in any orientation. In the continuous flow sublimation cooler of FIG. 4 as in the continuous flow sublimation cooler illustrated by FIG. 3, a cryogen 16 is supplied to the housing 50 from a cryogen reservoir, not shown in FIG. 4, through an inlet tube 36. The inlet tube 36, in this case, is connected to a top side wall of the housing 50. At the base of the housing 50 is a cold station 52. The cold station 52 covers the base of the housing 50 and extends a distance up along and around the sides of the housing 50. In the base of the housing 50 and above the cold station 52 are placed cold fingers 54. The cold fingers 54 are wires placed within the base, extending through the base, to allow flow from one side of the base, on the inside of the housing 50, to the space between the cold station 52 and the housing 50. The cold fingers are made of any material which provides good heat transfer, copper was used by the present inventors in testing and is mentioned for purposes of example only.

Placed on the inside of the housing 50, on top of and in contact with the base and cold fingers 54, is a porous plug 20. Thermally coupled to the porous plug 20 is the cold station 52 attached to the outside base of the housing 50. The porous plug 20 has a recess in its mid section extending through the plug 20 in which a ventilation tube 18 is placed. The top side of the housing 50 also has a recess of the same size and shape as that of the porous plug 20 in which the ventilation tube 18 extends through. The ventilation tube 18 has a tube 22 attached to its end extending outside of the housing 50 and to a vacuum. The object to be cooled 60 sits beneath the cold station 52 and the cryogen 16 is deposited into the housing 50 and rests above the porous plug 20.

Operation of the sublimation cooler will now be discussed. Attempts at building a continuous flow solid cryogen cooler, by the inventors of the present invention, focused on expanding liquid at a pressure of several atmospheres in a small diameter tube and having the snow that emerged from it impinge on a porous copper heat station while most of the gas and any excess solid by-passed the heat station and returned directly to the vent tube. A demonstration of this method was set up using $CO_2$ which has a triple point that is greater than atmospheric pressure and thus forms a solid that sublimes at 194K at atmospheric pressure. This worked very well. It was able to handle heat loads of more than 1 Watt with excellent temperature stability at temperatures from 195K to 207K when connected to a temperature controller.

Figure 5:
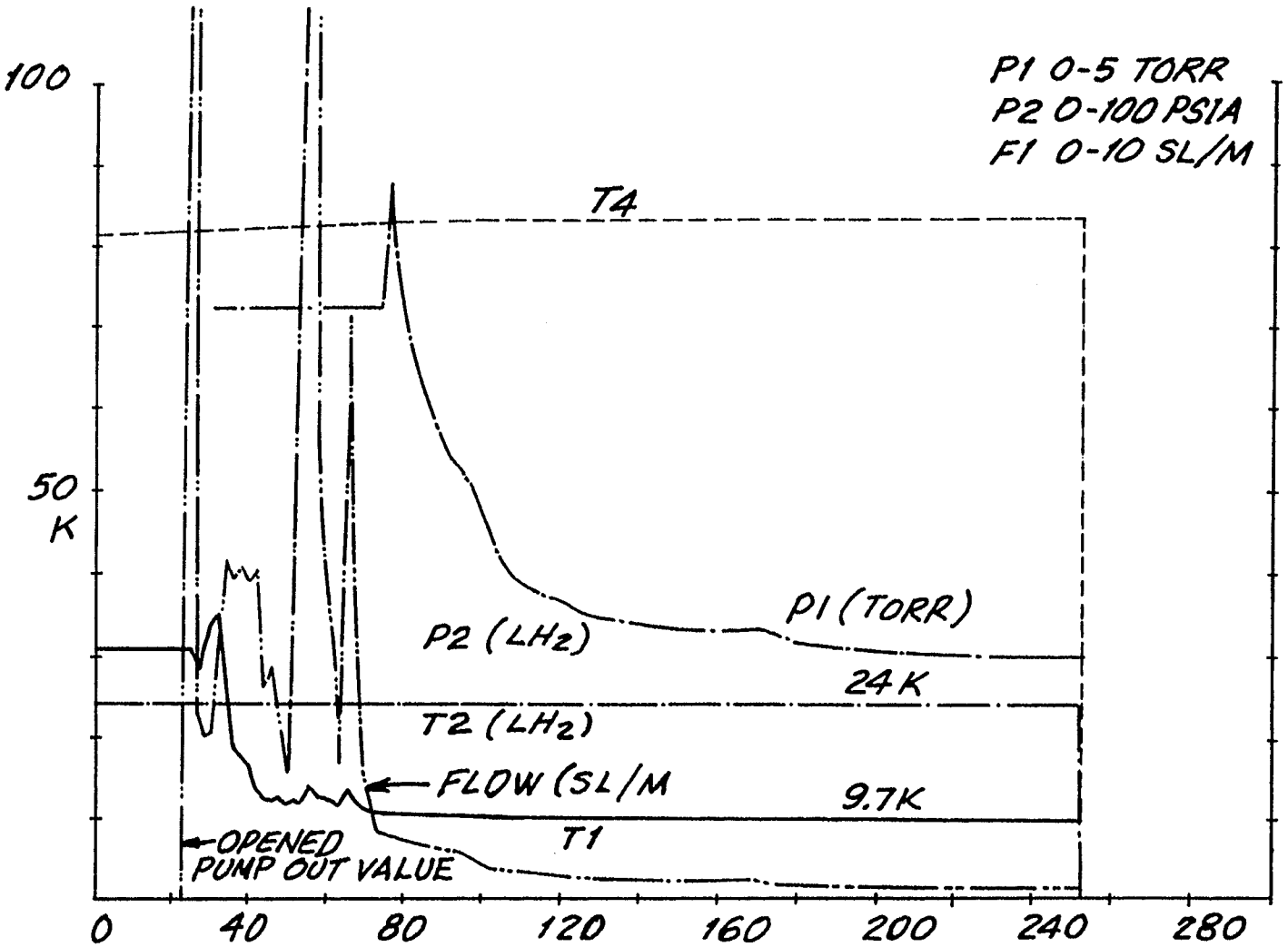
FIG. 5 is a graph illustrating the reaction of $H_2$ in a sublimation cooler of the present invention.
Figure 6:
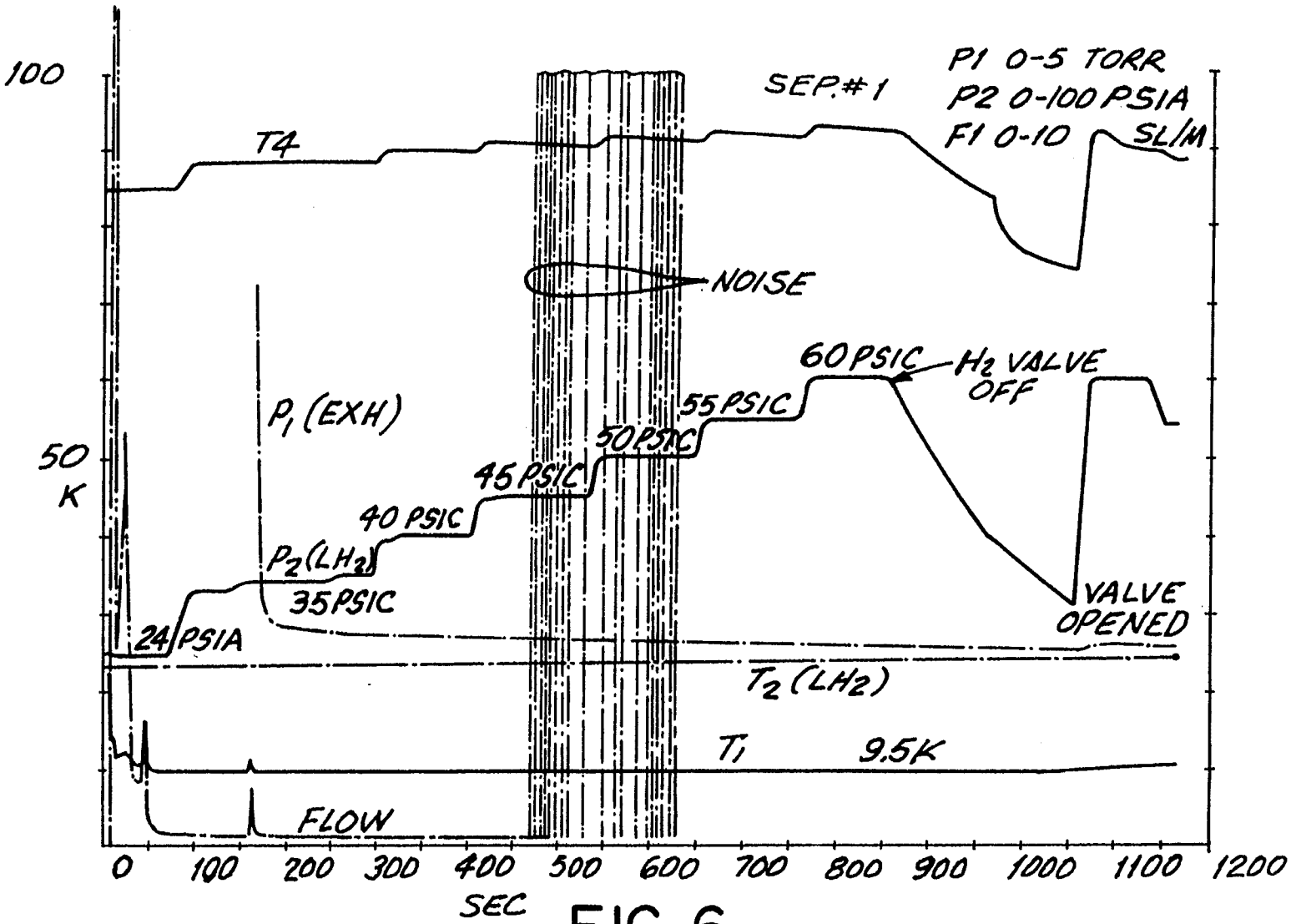
FIG. 6 is a second graph illustrating the reaction of $H_2$ in a sublimation cooler of the present invention.

When this same technique was tried with liquid $H_2$ it did not work because the $H_2$ froze in the capillary tube and the flow and temperature cycled, froze and thawed repeatedly. It was found, however, that by forcing all of the $H_2$ that emerged from the capillary tube to flow through the porous copper heat station, the solid $H_2$ that formed by periodically freezing in the capillary tube collected in the heat station until the flow was essentially blocked. The temperature and flow rate both then dropped and remained constant. This is shown in FIGS. 5 and 6.

The operation of the present invention with respect to FIG. 3 will now be discussed. The pressure is reduced at the warm end of the outlet tube 18, the end extending outside the housing, by the vacuum pump. The pressure is reduced to a magnitude less than the triple point pressure of the cryogen utilized. A chart listing triple point pressures and temperatures for various cryogens is provided later in this disclosure. The liquid cryogen is provided into the system continuously at a pressure greater than the triple point. The flow of the cryogen through the tube when a pressure at the outlet tube is less than that of the cryogen in the reservoir is in accordance with basic rules of physics. The cryogen entering the housing is drawn up into the porous plug where it evaporates, thus cooling the porous plug until the cryogen drawn up to the plug solidifies. The porous plug is of a density restrictive enough to reduce the pressure below the triple point of the cryogen during the period of cooling from the liquid supply temperature to the temperature where solid is formed on the porous plug. At this time, the flow of cryogen through the plug is reduced to a rate at which the solid cryogen in contact with the porous plug sublimes. Sublimation is the changing of a solid directly into gas. This occurs at the triple point temperature, the temperature at which an element can exist in solid, liquid and gas forms, of the element used as the cryogen. The rate at which the solid cryogen sublimes is proportional to the rate at which heat flows into the solid surface of the cryogen. The heat flows by conduction from and through the solid cryogen and liquid cryogen as the cryogen is cooled from the liquid temperature to the temperature at which it sublimes. Heat also flows from both parasitic losses and from the object being cooled.

Solid cryogen forms below the porous plug and continually moves towards the plug due to pressure differences across the solid. As the solid moves closer to the plug, due to both pressure differences across its surface and sublimation of the cryogen close to the plug, the thickness of the solid remains constant due to the solidifying of the liquid cryogen beneath the solid layer. If the heat load is increased there is a steeper temperature gradient in the solid and liquid cryogen below the porous plug and the solid layer therefore becomes thinner. Likewise a reduction in heat load causes the solid layer to increase in thickness. The area below the porous plug should be of sufficient size to accommodate the change in solid thickness so that the area does not totally fill up with solid cryogen. The porous plug is thermally coupled to the cold station temperature sensor and object being cooled. The object to be cooled is thus cooled to the temperature of the porous plug and kept at that temperature along with the porous plug and cold station.

In order for the vacuum pump to continuously reduce the pressure during the initial cool down it is necessary for the flow of cryogen into the housing to be restricted. This restriction of flow is accomplished either by the pore size of the matrix of the porous plug as in FIG. 1 or by a restriction in the inlet tube as in FIG. 2. The inlet tube in FIG. 2 is of a diameter so as to restrict the flow of cryogen allowed to enter the housing to an acceptable rate. The flow may be further restricted or regulated by the pressure in the cryogen reservoir which is supplied liquid cryogen through a tube. The external control of the pressure of liquid cryogen in the reservoir controls the rate at which cryogen can flow through the inlet tube. This cooler, typically, would be mounted in a vacuum insulated cryostat along with the device for maintaining a continuous supply of liquid in the reservoir. This may be accomplished by use of a liquid transfer system from a large dewar, a closed cycle cryocooler such as Gifford McMahon or Stirling cycle cooler, or a Joule Thomson cryocooler.

Operation of the continuous flow sublimation cooler of FIG. 4 will now be discussed. This embodiment is designed in a manner in which the cold station cools an object mounted on an adjacent cold plate. The porous plug and cold station are located at the base of the housing. The housing is tapered at a level above that of the porous plug. The tapering of the upper part of the housing is a means of changing the temperature gradient by changing the cross-sectional area of heat flow. The tapering of the housing may also reduce the possibility of solid cryogens sticking to the housing walls. Sticking, of the solid cryogens tested, to the housing walls, has not been a problem although there is a possibility such a problem may arise.

In this embodiment, the vacuum pump operates pumping the upper end of the output tube at a pressure less than the triple point pressure of the cryogen utilized. The application of this reduced pressure in the output tube causes liquid cryogen to flow from the cryogen reservoir through the inlet tube and into the housing. The liquid cryogen is deposited on top of the porous plug. The cryogen is drawn into the porous plug then through the open areas around the cold fingers at the base of the housing. The liquid cryogen drawn into the porous plug evaporates and cools the plug until solid cryogen forms on top of the plug. At this time, the flow of cryogen through the porous plug is reduced to the rate at which solid cryogen in contact with the plug sublimes. The porous plug is thermally coupled to the cold station. The cold station is attached to the base of the housing on the opposite side of the porous plug and is also in contact with the object being cooled. The cooling of the porous plug thus cools the object placed in contact with the cold station.

The diameter and length of the housing may vary although the housing should be of a dimension such that the temperature difference between the object being cooled and the subliming surface is small and liquid is always present at the back end of the housing, where the liquid enters. Increasing the diameter reduces the temperature difference but also reduces the heat flux through the solid and increases the thickness of the solid layer. Having a thick layer of solid can provide additional thermal storage which can absorb brief periods of high heat input.

The rate at which the flow rate changes after a change in heat load is a function of the orientation of the housing as well as its geometry. When the unit is oriented cold end down, as in FIG. 4, the liquid above the solid stratifies because the colder liquid is denser than the warmer liquid and heat flow out of the liquid is governed only by conduction. When the unit is in a horizontal or cold end up orientation, as in FIGS. 1–3, convection dominates. If the cooler of FIG. 4 is run as cold end up then convection results in all of the liquid in the housing being at a temperature just above the triple point temperature of the liquid and the temperature gradient between the triple point temperature and the liquid supply temperature is in the capillary tube where convection is constrained.

Table 1, below, lists the most likely gases to be used with the cooling device of the present invention although other gases may be used. Helium, which does not freeze except at high pressure, and some fluids such as propane, which has a triple point temperature of 85.5K. and pressure of 1.5E-6 Torr, are not good candidates for practical application of this cooling method.

TABLE 1

| | Cryogen Properties | | | |
|---|---|---|---|---|
| | T at 1 Atm | Triple Point | | T at 1 Torr |
| Gas | K | Torr | K | K |
| Hydrogen | 20.3 | 53 | 13.9 | 9.5 |
| Neon | 27.1 | 333 | 24.5 | 15.8 |
| Nitrogen | 77.3 | 94 | 63.2 | 47.0 |
| Oxygen | 90.2 | 1.1 | 54.4 | 54.1 |
| Argon | 87.3 | 518 | 83.8 | 54.4 |
| Methane | 111.7 | 88 | 90.7 | 67.3 |
| Krypton | 120.0 | 549 | 116.2 | 74.8 |

The inventors of the present invention have built and tested devices of the types described below that have varied in size from 15 mm to 30 mm diameter with housing lengths of 30 mm to 60 mm using liquid $N_2$ at atmospheric pressure and liquid $H_2$ at 1 to 5 atmospheres pressure venting to a vacuum pump with a displacement of 370 L/min at less than 1 Torr (1 mm Hg) pressure. The $N_2$ sublimation cooler of the type shown in FIG. 1 operated at a steady temperature of 60K for about 15 minutes. A layer of solid $N_2$ was observed to form and reach a constant thickness of 13 mm after 10 minutes of operation. The $H_2$ unit which was built as shown in FIG. 3 maintained a temperature of less than 10K for over an hour with a heat load of about 100 mW. The temperature and rate at which $H_2$ sublimed remained constant when the supply pressure was changed over the range of 1 to 5 Atm. The rate of sublimation increased and decreased as the heat load was increased and decreased, but the change was very slow.

There has been disclosed heretofore the best embodiment of the invention presently contemplated. However, it is to be understood that various changes and modifications may be made thereto without departing from the spirit and scope of the invention.

What is claimed:

1. A cryogen cooler for providing continuous refrigeration at a temperature below the triple point of the cryogen comprising:

an insulated housing;

a porous plug within the housing;

means for continuously supplying a liquid cryogen to the porous plug at a pressure greater than the triple point of the cryogen; and means for providing an exhaust from the porous plug at a pressure below the triple point of the cryogen.

2. A cryogen cooler as in claim 1, wherein said porous plug is of a matrix sufficiently restrictive to the flow of the liquid cryogen therethrough to reduce the pressure of the cryogen to below the triple point during the period of cooling from the liquid supply temperature to the point where solid cryogen is formed on the porous plug.

3. A cryogen cooler as in claim 1, and further comprising a liquid cryogen supply means, a tube coupling said supply means to the housing, said tube being sufficiently restrictive to reduce the pressure of the cryogen to below the triple point during the period of cooling from the liquid supply temperature to the point where solid cryogen is formed on the plug.

4. A cryogen cooler as in claim 1 and further comprising:

an outlet tube having a first end within the housing and in close proximity to the porous plug and a second end extending outside the housing; and a vacuum pump attached to the second end of the outlet tube.

5. A cryogen cooler as claimed in claim 4 wherein the porous plug is attached to an inside top side of the housing.

6. A cryogen cooler as claimed in claim 5, further comprising a cap having a recess and being attached to the top side of the housing wherein a cold station is positioned at the cap and the first end of the outlet tube is positioned within the recess in the cap.

7. A cryogen cooler as claimed in claim 1, wherein the porous plug is composed of a material having high thermal conductivity.

8. A cryogen cooler as claimed in claim 1, wherein the porous plug includes a recess in a midsection thereof and is attached to a bottom wall within the housing.

9. A cryogen cooler as claimed in claim 8, wherein the bottom wall of the housing includes cold fingers.

10. A cryogen cooler as claimed in claim 9, wherein the first side of the outlet tube is positioned within the recess in the porous plug.

11. A cryogen cooler as in claim 1, and further comprising, a reservoir for storing the liquid cryogen, and an inlet tube coupling the reservoir to said housing.

12. A cryogen cooler as claimed in claim 1, wherein the housing is tapered inward from the porous plug to the inlet tube.

13. A cryogen cooler as claimed in claim 1, wherein an object to be cooled is in contact with a cold station on the outside of the housing and said cold station is in contact with the porous plug on the inside of the housing.

14. A cryogen cooler as in claim 1, wherein the housing is of a sufficient length whereby under normal use solid cryogen is adjacent the supply side of the porous plug and liquid cryogen is always present between the solid and the means for supplying.

15. A cryogen cooler as in claim 1 and wherein said means for supplying and said exhaust means are on the same side of the housing.

16. A cryogen cooler as in claim 11, and further comprising a vacuum insulated cryostat in which is located said housing and said reservoir.

17. A method of providing continuous refrigeration at a temperature below the triple point of a cryogen comprising the steps of:

a) supplying a liquid cryogen to a porous plug contained in an insulated housing at a pressure greater than the triple point of the cryogen; and b) maintaining a pressure below the triple point of the cryogen at the exhaust from the porous plug.

18. The method of claim 17, further comprising the step of supplying the liquid cryogen in a restrictive manner from an external reservoir through the use of a restrictive porous plug to reduce the pressure below the triple point during the period of cooling from the liquid supply temperature to the point where solid is formed on the plug.

19. The method of claim 18 further comprising the step of restricting the flow of cryogen to the porous plug through a narrow diameter flow tube supplying the cryogen to reduce the pressure below the triple point during the period of cooling from the liquid supply temperature to the point when solid cryogen is formed on the plug.

20. The method of claim 17, wherein the porous plug is positioned on a base of a housing and the liquid cryogen is supplied to the housing through a top side thereof and rests atop the porous plug.

21. The method of claim 17, wherein the porous plug is positioned at a top side of a housing and the liquid cryogen is supplied to the housing enters through a base side thereof and rests on the base side beneath the porous plug.

* * * * *